US008317302B2

(12) United States Patent
Kyoso

(10) Patent No.: US 8,317,302 B2
(45) Date of Patent: Nov. 27, 2012

(54) RESTRICTION OF FLUID EJECTOR MEMBRANE

(75) Inventor: Tadashi Kyoso, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 264 days.

(21) Appl. No.: 12/727,178

(22) Filed: Mar. 18, 2010

(65) Prior Publication Data

US 2011/0228011 A1 Sep. 22, 2011

(51) Int. Cl.
*B41J 2/045* (2006.01)

(52) U.S. Cl. ..... 347/68; 347/71; 347/72; 347/50; 29/25.35; 310/312; 310/327

(58) Field of Classification Search ..... 347/68, 347/71, 72, 50; 310/312, 327; 29/25.35
See application file for complete search history.

(56) References Cited

U.S. PATENT DOCUMENTS

2007/0035579 A1 2/2007 Bibl et al.

FOREIGN PATENT DOCUMENTS

JP 2006-142504 6/2006
WO 2009/142908 11/2009

*Primary Examiner* — Matthew Luu
*Assistant Examiner* — Henok Legesse
(74) *Attorney, Agent, or Firm* — Fish & Richardson P.C.

(57) ABSTRACT

A fluid ejection module includes a die having a plurality of substantially identical fluid ejector units formed therein. Each fluid ejector unit includes a flow path formed therethrough, the flow path including a pumping chamber fluidically connected to a nozzle, and an actuator assembly including a membrane providing a wall of the pumping chamber and an actuator, the actuator assembly configured to eject fluid from a pumping chamber through an associated nozzle. The plurality of individually actuatable fluid ejector units includes a plurality of individually actuatable first fluid ejector units and at least one second fluid ejector unit, and the actuator assembly of the at least one second fluid ejector unit includes a material deposited on the actuator such that the actuator assembly of the at least one second fluid ejector unit is stiffer than the actuator assemblies of the first fluid ejector units.

24 Claims, 8 Drawing Sheets

RESTRICTION OF FLUID EJECTOR MEMBRANE

TECHNICAL FIELD

This disclosure relates to fluid ejection devices.

BACKGROUND

Microelectromechanical systems, or MEMS-based devices, can be used in a variety of applications, such as accelerometers, gyroscopes, pressure sensors or transducers, displays, optical switching, and fluid ejection. Typically, one or more individual devices are formed on a single die, such as a die formed of an insulating material or a semiconducting material, which can be processed using semiconducting processing techniques, such as photolithography, deposition, or etching.

One type of fluid ejection module includes a die with a plurality of fluid ejectors for ejecting fluid and a flexible printed circuit ("flex circuit") for communicating signals to the die. The die includes nozzles, ink ejection elements, and electrical contacts. The flex circuit includes leads to connect the electrical contacts of the die with driving circuits, e.g., integrated circuits that generate a drive signal for controlling ink ejection from the nozzles. In some fluid ejection modules, the driving circuits can be part of an integrated circuit chip that is mounted on the flex circuit.

The density of nozzles in the fluid ejection module has increased as fabrication methods improve. For example, MEMS-based devices, frequently fabricated on silicon wafers, are formed in dies with a smaller footprint and with a nozzle density higher than previously. However, the smaller footprint of such devices can reduce the area available for electrical contacts on the die.

SUMMARY

In one aspect, a fluid ejection module includes a die having a plurality of substantially identical individually actuatable fluid ejector units formed therein. Each fluid ejector unit includes a flow path formed therethrough, the flow path including a pumping chamber fluidically connected to a nozzle, and an actuator assembly including a membrane providing a wall of the pumping chamber and an actuator, the actuator assembly configured to eject fluid from a pumping chamber through an associated nozzle. The plurality of individually actuatable fluid ejector units includes a plurality of individually actuatable first fluid ejector units and at least one second fluid ejector unit, and the actuator assembly of the at least one second fluid ejector unit includes a material deposited on the actuator such that the actuator assembly of the at least one second fluid ejector unit is stiffer than the actuator assemblies of the first fluid ejector units.

Implementations can include one or more of the following features. The material may be glue, epoxy or solder. The pumping chamber may be positioned on a first side of the membrane, the material may be positioned on a second side of the membrane opposite to the first side, and the material may be the outermost layer of the actuator assembly. A stiffness of the actuator assembly of the at least one second fluid ejector unit may be at least two times greater than a stiffness of the actuator assemblies of the first fluid ejector units. A thickness of the material may be between about 1 μm and 100 μm. An integrated circuit element may be configured to generate a voltage pulse to actuate the actuators. A first trace connecting the actuator assembly of the at least one second fluid ejector unit and the integrated circuit element may have a short to a second trace, which connects the actuator assembly of one of the plurality of first fluid ejector units and the integrated circuit element. The integrated circuit element may include a plurality of switching elements, and a switching element connected to the actuator assembly of the second fluid ejector unit may be configured to be always closed. The voltage pulse required to actuate the actuator of the second fluid ejection unit may be at least twice as high as the voltage pulse required to actuate the actuators of the first fluid ejection units. The actuator may include a piezoelectric layer. The die may include silicon.

In another aspect, a fluid ejection module includes an integrated circuit element configured to generate a voltage pulse, and a die having a plurality of substantially identical individually actuatable fluid ejector units formed therein. Each fluid ejector unit includes a flow path formed therethrough, the flow path including a pumping chamber fluidically connected to a nozzle, and an actuator assembly including a membrane providing a wall of the pumping chamber and an actuator, the actuator assembly configured to eject fluid from a pumping chamber through an associated nozzle when actuated by the voltage pulse. The plurality of individually actuatable fluid ejector units includes a plurality of first fluid ejector units and at least one second fluid ejector unit, and the actuator assembly of the at least one second fluid ejector unit includes a material deposited thereon such that at least some voltage pulses are sufficient to eject fluid from the plurality of first fluid ejector units, but not sufficient to eject fluid from the second fluid ejector unit.

Implementations can include one or more of the following features. The voltage pulse may be about 32V. The material may be glue, epoxy or solder. The pumping chamber may be positioned on a first side of the membrane, the material may be positioned on a second side of the membrane, the second side opposite to the first side, and the material may be the outermost layer of the actuator assembly. The thickness of the material may be between about 1 μm and 100 μm. A first trace connecting the actuator assembly of the second fluid ejector unit and the integrated circuit element may have a short to a second trace, which connects the actuator assembly of one of the plurality of first fluid ejector units and the integrated circuit element. The integrated circuit element may include a plurality of switching elements, and a switching element connected to the actuator assembly of the second fluid ejector unit may be configured to be always closed. The actuator may include piezoelectric layer. The die may include silicon.

In another aspect, a method of correcting fluid ejection errors includes placing a liquid on at least one second fluid ejector unit of a fluid ejection module and not on a plurality of first fluid ejector units, and curing the liquid such that the actuator assembly of the second fluid ejector unit is stiffer than the actuator assemblies of the first fluid ejector units. Each fluid ejector unit includes a flow path including a pumping chamber fluidically connected to a nozzle, and an actuator assembly including a membrane providing a wall of the pumping chamber and an actuator, the actuator assembly configured to eject fluid from a pumping chamber through an associated nozzle.

Implementations can include one or more of the following features. An integrated circuit element may be attached to the die prior to placing the liquid, the integrated circuit element configured to generate a voltage pulse to actuate the actuators. Prior to placing the liquid, determining that a switching element of the integrated circuit element connected to the actuator assembly of the second fluid ejector unit is configured to be always closed. Prior to placing the liquid, determining that there is a short in a trace connecting the actuator assembly of the second fluid ejector unit and the integrated circuit element.

Potential advantages of some implementations can include one or more of the following. Printing errors, caused by defects in either an integrated circuit chip that drives actuators on the fluid ejector die or in traces on the fluid ejector die that connect the integrated circuit chip to the actuators, can be reduced.

BRIEF DESCRIPTION OF THE FIGURES

FIG. 6 is a schematic of a fluid ejector module having integrated circuit chip with an integrated circuit element having switch that is always on.

FIG. 7A is a schematic of a fluid ejector module having a material deposited on an actuator connected to the switch that is always on.

DETAILED DESCRIPTION

During fluid droplet ejection, e.g., for ink jet printing, shorts and other defects in an integrated circuit chip that drives actuators on a fluid ejector die can cause a nozzle to be "always on," i.e., to eject fluid regardless of the image data. This can result in a continuous line being printed on the print media, i.e., a line in the direction of travel of the print media at a location corresponding to the nozzle of the defective fluid ejector unit. Such a line is usually a highly visible printing defect. However, by depositing a material on the actuator assembly to which the short or defect is connected, the actuator can be prevented from firing. This causes the nozzle to be effectively "always off" rather than "always on". Such an error is less visible, and itself can be partially compensated for by increasing the size of fluid droplets ejected from adjacent nozzles.

Another problem can occur when there are defects in traces on the fluid ejector die that connect the integrated circuit chip to the actuator assemblies. In such cases, a short between two traces degrades performance of both corresponding nozzles. However, by depositing a material on one of the actuator assemblies, the other actuator assembly can be restored to normal function.

Figure 1:
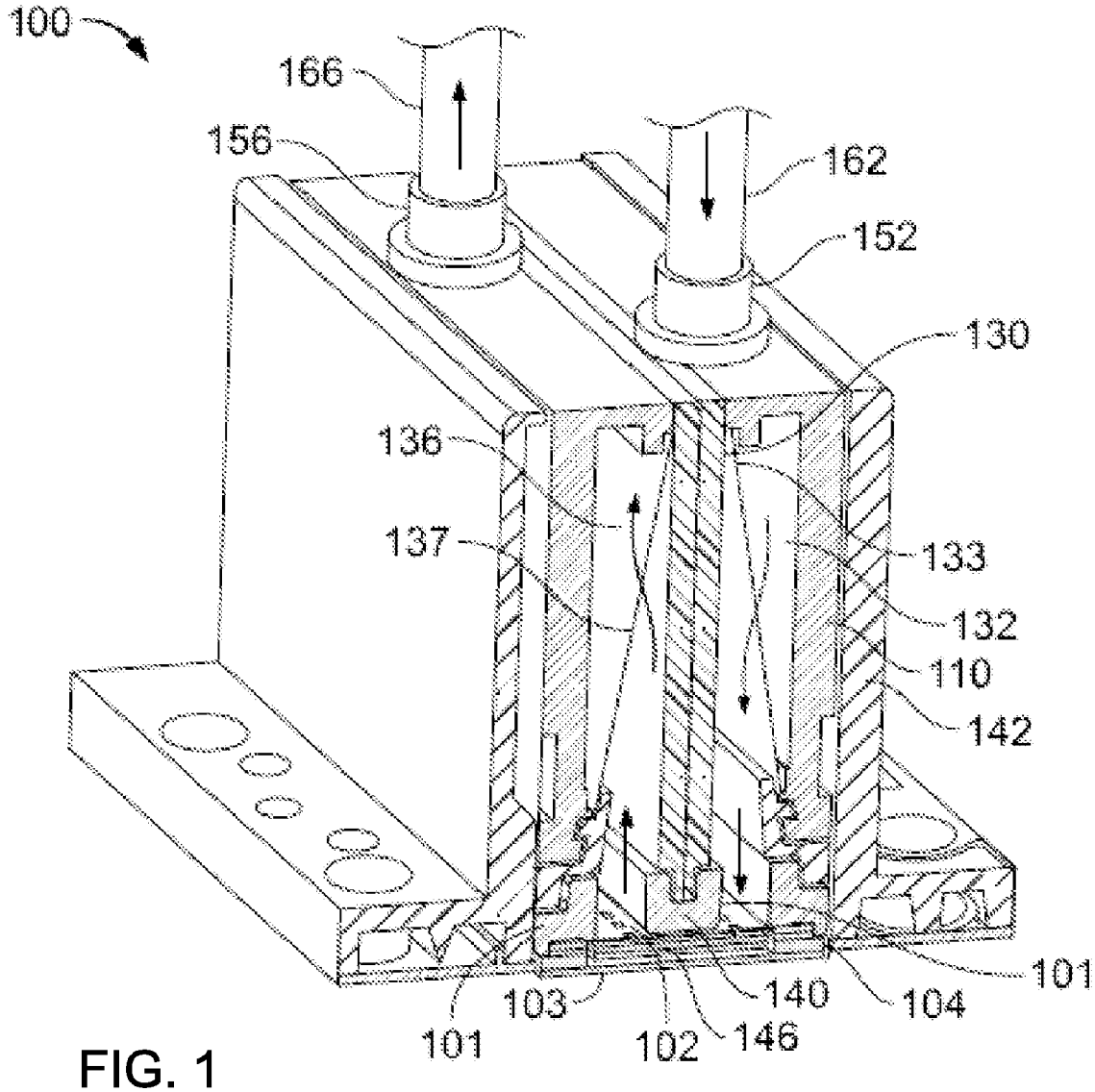
FIG. 1 is a perspective cross-sectional view of an exemplary fluid ejector.

An exemplary fluid ejector is shown in FIG. 1. The fluid ejector 100 includes a fluid ejection module 103, e.g., a quadrilateral plate-shaped printhead module, which can be a die fabricated using semiconductor processing techniques. The fluid ejected from the fluid ejector 100 can be ink, but the fluid ejector 100 can be suitable for other liquids, e.g., biological liquids or liquids for forming electronic components.

The fluid ejector 100 can also include a housing 110 to support and provide fluid to the die 103, along with other components such as a mounting frame 142 to connect the housing 110 to a print bar, and a flex circuit 201 to receive data from an external processor and provide drive signals to the die. The housing 110 can be divided by a dividing wall 130 to provide an inlet chamber 132 and an outlet chamber 136. Each chamber 132 and 136 can include a filter 133 and 137. Tubing 162 and 166 that carries the fluid can be connected to the chambers 132 and 136, respectively, through apertures 152 and 156. The dividing wall 130 can be held by a support 144 that sits on an interposer assembly 146 above the die 103.

Fluid inlets 101 and fluid outlets 102 allow fluid to circulate from the inlet chamber 132, down through the optional interposer assembly 146, through the fluid ejection module 103, back up through the optional interposer assembly 146, and into the outlet chamber 136. A portion of the fluid passing through the fluid ejection module 103 is ejected from the nozzles.

Figure 2:
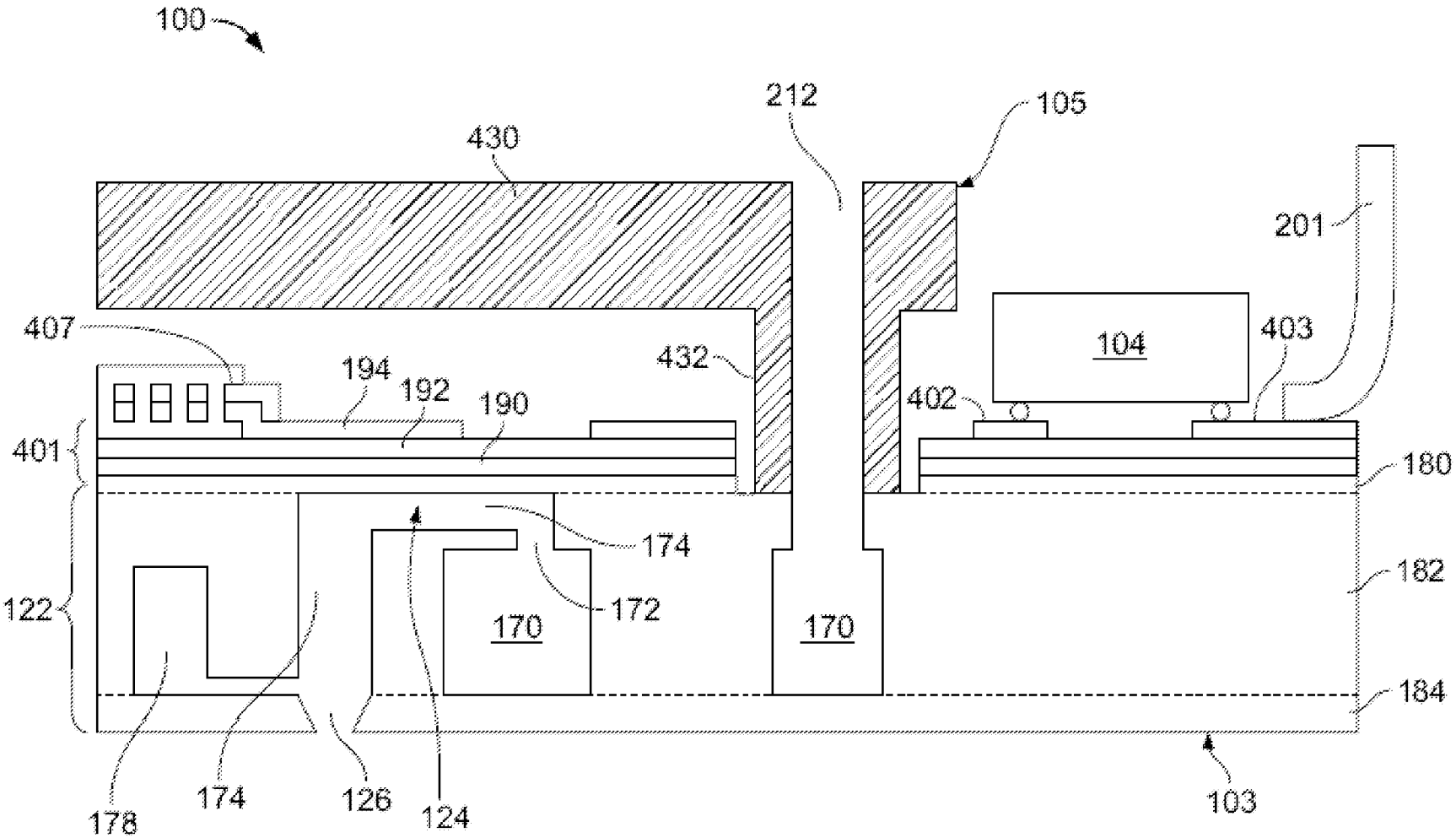
FIG. 2 is a schematic cross-sectional view of a fluid ejector module and other element from an exemplary fluid ejector.

Referring to FIG. 2, the fluid ejection module 103 can include a substrate 122 in which are formed a plurality of fluid flow paths 124, each flow path 124 ending in an associated nozzle 126 (only one flow path is shown in FIG. 2). The fluid inlet 102 is fluidically connected to an ink feed passage 170 through the substrate 122 (the two areas labeled 170 in FIG. 2 can be connected by a passage extending out of the page). The ink feed passage 170 is, in turn, fluidically connected in common to multiple fluid flow paths 124. Each fluid flow path 124 can include an ascender 172, a pumping chamber 174, and a descender 176 that ends in the nozzle 126. The fluid path can further include a recirculation path 178 so that ink can flow through the ink flow path 124 even when fluid is not being ejected.

The substrate 122 can include a flow-path body 182 in which the flow path is formed by semiconductor processing techniques, e.g., etching, a membrane 180, such as a layer of silicon, which seals one side of the pumping chamber 174, and a nozzle layer 184 through which the nozzle 128 is formed. The membrane 180, flow path body 182 and nozzle layer 184 can each be composed of a semiconductor material (e.g., single crystal silicon). The membrane can be relatively thin, such as less than 25 μm, for example about 12 μm.

The fluid ejection module 103 also includes individually controllable actuators 401 supported on the substrate 122 for causing fluid to be selectively ejected from the nozzles 126 of corresponding fluid paths 124 (only one actuator is shown in FIG. 2). Each flow path 124 with its associated actuator 401 provides an individually controllable MEMS fluid ejector unit. Each actuator 401 is positioned over an associated pumping chamber 174. Thus, the fluid ejector module 103 includes a plurality of substantially identical (i.e., congruent and constructed of the same materials), independently actuatable fluid ejector units.

In some embodiments, activation of the actuator 401 causes the membrane 180 to deflect into the pumping chamber 174, forcing fluid out of the nozzle 126. For example, the actuator 401 can be a piezoelectric actuator, and can include a lower conductive layer 190, a piezoelectric layer 192, and an upper conductive layer 194. In some implementations, the lower conductive layer 190 is a common electrode across all actuators 401, e.g., a ground electrode. In some implementations, the piezoelectric layer is segmented with gaps between adjacent actuators 401, whereas in other implementations, the piezoelectric layer is continuous across multiple actuators 401. The piezoelectric layer 192 can be between, e.g., about 1 and 25 microns thick, e.g., about 8 to 18 microns thick. An actuator 401 and corresponding portion of the membrane 190 under the actuator 401 together provides an actuator assembly.

The fluid ejector 100 further includes one or more integrated circuit elements 104 configured to provide electrical signals for control of ejection of fluid from the die 103 through nozzles located on the underside of the die 103. The integrated circuit element 104 can be a microchip, other than the die 103, in which integrated circuits are formed, e.g., by semiconductor fabrication and packaging techniques. Thus, the integrated circuits of the integrated circuit element 104 are formed in a separate semiconductor substrate from the substrate of the die 103. However, the integrated circuit element 104 can be mounted directly onto the die 103.

Figure 3:
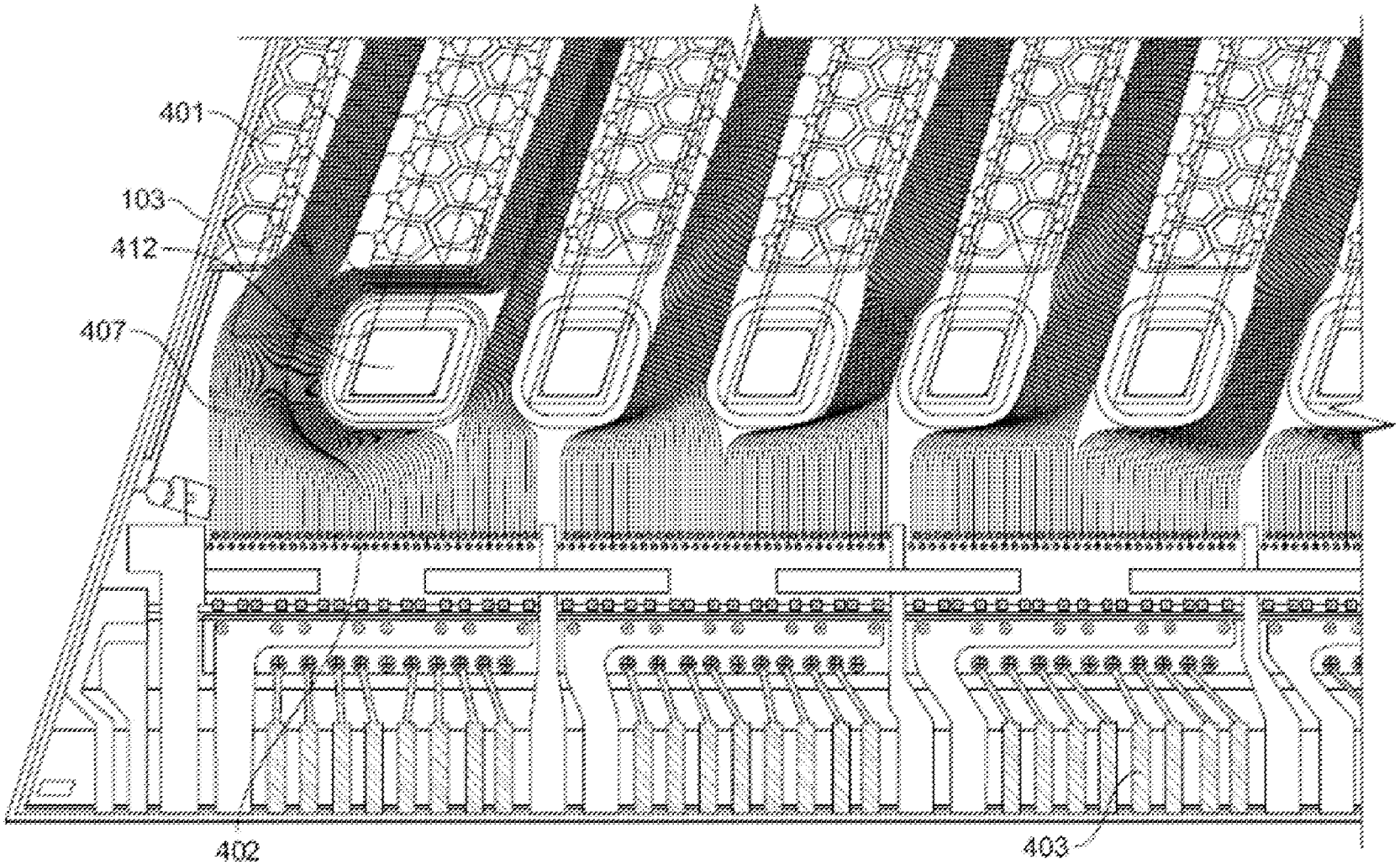
FIG. 3 is a plan view of an exemplary die with circuitry.

A plan view of an exemplary die having circuitry is shown in FIG. 3. The multiple actuators 401 on the die 103 can be disposed in columns. The actuators 401 shown in FIG. 3 are piezoelectric elements, e.g., each actuator includes a piezoelectric layer between two electrodes. For each actuator 401, a drive electrode, e.g., the top electrode 194, is connected to a corresponding input pad 402 by way of a conductive trace 407 that is also located on the die 103 (FIG. 3 illustrates only a single trace 407 for simplicity). The traces 407 can extend between the columns of actuators 401.

In some embodiments, a fluid inlet 412 is formed at the end of a column of actuators 401. At an opposite end of the column, a fluid outlet can be formed in the top of the die 103. A single fluid inlet and fluid outlet pair can serve one, two, or more columns of fluid ejection elements 401. The die 103 further includes conductive input traces 403 arranged along one or more edges of the die 103. The flex circuit 201 (see FIG. 2) can be bonded into the input traces 403 of the die 103. For example, the flex circuit 201 can be connected to the distal ends of the traces 403 at the edge of the die 103.

Figure 4:
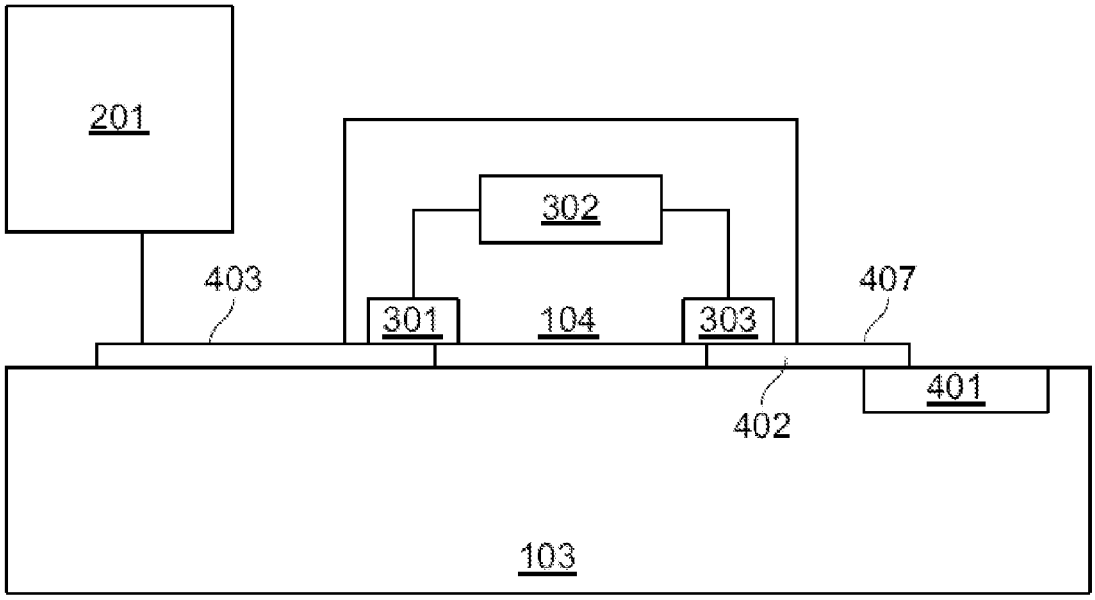
FIG. 4 is a schematic diagram of the electrical connections between the flex circuit, die, and integrated circuit elements.

The integrated circuit element 104 is electrically connected to the actuators 401, as shown schematically in FIG. 4 (only one actuator is shown in FIG. 4). The integrated circuit element 104 is configured to provide signals to control the operation of the actuators 401. For example, the integrated circuit element 104 can include a switch 302, e.g., a transistor, for each actuator to control whether a drive signal is applied to the actuator. The integrated circuit element can be electrically connected to the actuators 401 and the input traces 403, which receive control signals from the flex circuit 201, by leads, contacts pads and conductive traces. For example, a signal, such as a drive signal, can be sent from the flex circuit 201 to the input trace 403 on the die 103 and transmitted through a conductive lead 301 into the integrated circuit element 104. If the switch 302 is closed, then the signal is transmitted from the integrated circuit element 104 through a conductive lead 303 onto a conductive trace 407 on the die 103, and through the conductive trace 407 to the drive electrode (e.g., the top electrode 194) of the actuator 401. On the other hand, if the switch 302 is open, then the signal is not transmitted to the actuator 401. In general, there will be a switch 302, a lead 303 and a conductive trace 407 for each associated actuator 401.

Figure 5:
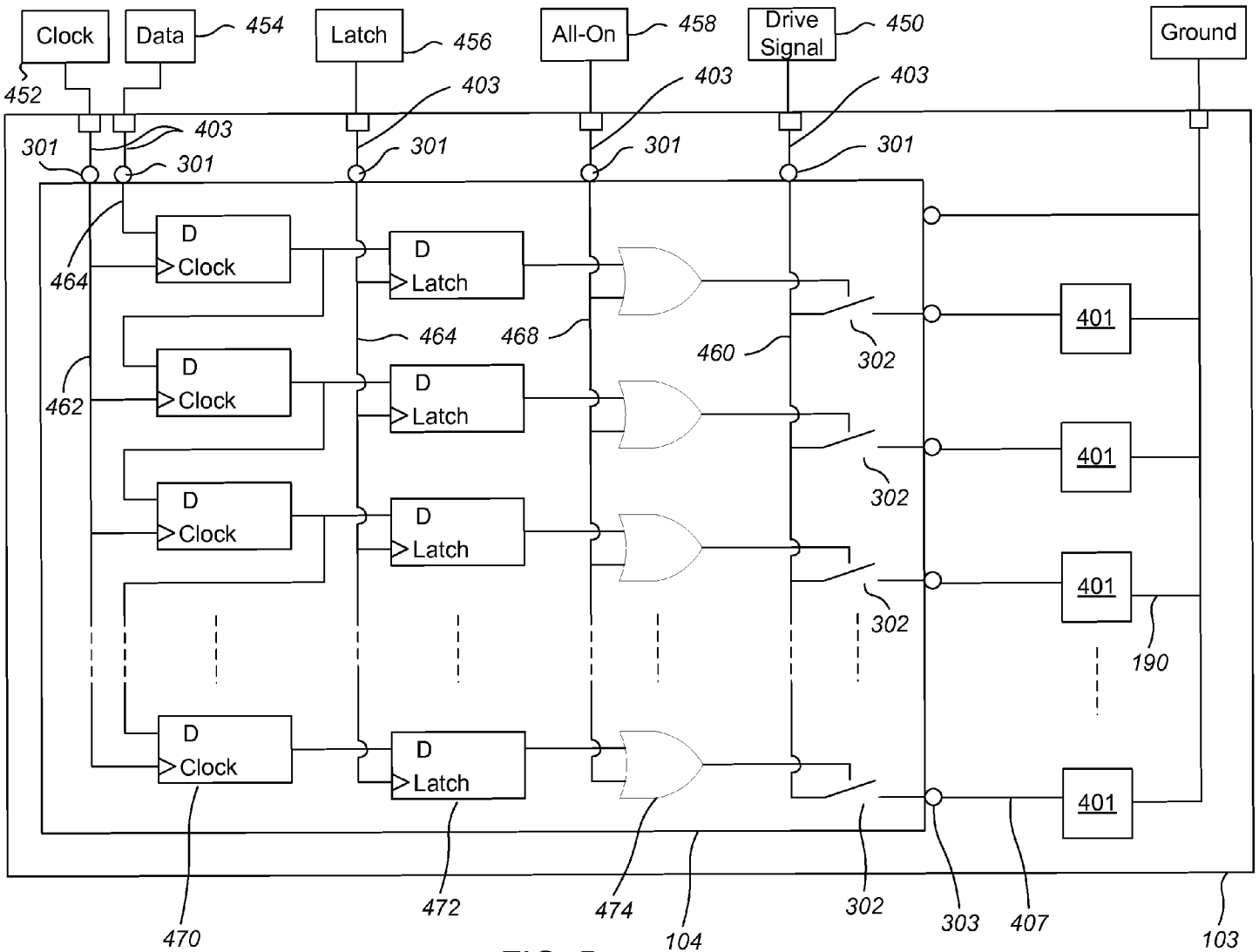
FIG. 5 is schematic circuit diagram of a die and a integrated circuit chip mounted on the die.

The integrated circuit element 104 can include more complex circuitry to receive data and control operation the actuators 401. A circuit diagram of the integrated circuit chip 104 and die 103 is shown in FIG. 5.

As noted, the integrated circuit element 104 includes integrated switching elements 302. Each switching element acts as an on/off switch to selectively connect the drive electrode of one MEMS fluid ejector units to a common drive signal source 450. For example, the input terminals of each switching element 302 can be connected a common internal drive voltage line 452 in the chip 104, and the internal drive voltage line 460 can be electrically connected to the conductive trace 403 on the die 103 by the conductive lead 301. The conductive trace 403 can be electrically connected in turn, e.g., at a contact pad 408, to the flex circuit which carries the drive signal from the source 450.

Other inputs to the chip 104 can include a clock signal from a clock signal source 452, a data signal from a data signal source 454, a latch signal from a latch signal source 456, and an all-on signal from an all-on signal source 458, which are electrically connected to an internal clock line 462, internal data line 464, internal latch line 466 and internal all-on line 468, respectively, by their own respective conductive traces 403 and conductive leads 301. The chip 104 can also be connected to a power line and a ground line, e.g., the common electrode 190.

Signals from the flex circuit 201 are sent through the input leads 301 to control circuitry in the chip 104, which can include data flip-flops 470, latches 472, OR-gates 474, and the switches 302. Specifically, in some implementations, each actuator 401 has an associated data flip-flop 470, latch 472, OR-gate 474 and switch 302. The data flip flops 470 are connected in a shift register arrangement, with each data flip flop 470 having a data input connected to the output of the prior data flip flop 470 in the register (excepting the first data flip flop, which is connected to the internal data line 464), and an output connected to both the associated latch 472 and the data input of the next data flip flop 470 (excepting the last data flip flop, which is connected only to the associated latch 472). The clock input of each data flip flop 470 is connected to the common clock line 462, and the latch input of each latch 472 is connected to the common latch line 466. The output of each latch 472 is connected to the first input of an associated OR-gate 474, and the second input of each OR-gate is connected to the common all-on-line 468. The output of the OR-gate 474 is connected to the control terminal of the associated switch 302 to control whether the switch is closed (and connects the associated actuator 401 with the drive signal) or open.

In operation, a signal is processed by sending data through the data line 464 to the data flip-flops 470. The clock line 462 then clocks the data as it is entered. Data is serially entered such that the as each bit of data is entered in the first data flip-flop, data shifts from each flip flop 470 shifts down to the next flip flop in the register. After all of the data flip-flops 470 contain data, a pulse is sent through the internal latch line 466 to shift the data from the data flip-flops 470 to the latches 472. If the signal from the latch 472 is high, then the associated switch 302 is turned on, i.e., closed, and sends the drive signal from the internal drive voltage line 452 through output lead 303 and traces 407 to drive the actuator 401. If the signal is low, then the switch 302 remains off (i.e., open), and the fluid ejection element 401 is not activated.

Figure 6:
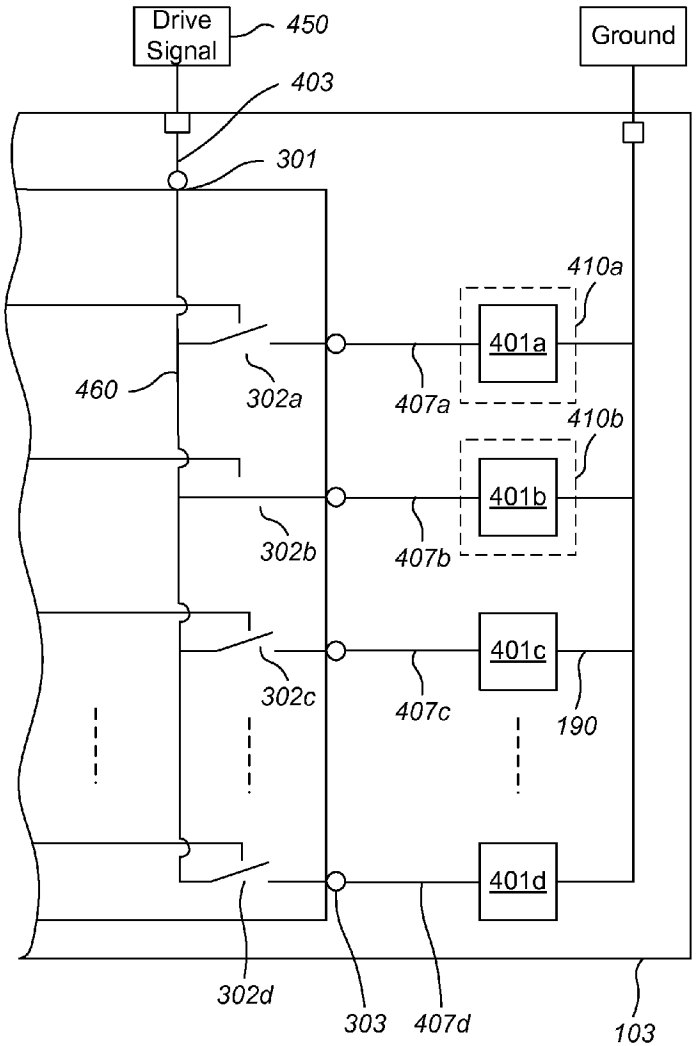

One problem, as noted above, is that a defect in integrated circuit element can cause a nozzle to be "always on," e.g., to eject fluid in response to application of a drive pulse, regardless of the image data. This can result in a continuous line being printed on the print media, i.e., a line parallel to the direction of travel of the print media at a location corresponding to the nozzle connected to the defective circuit. For example, referring to FIG. 6, multiple fluid ejector units are fabricated on a single die 103, with the actuator 401*a*-401*d* of each fluid ejector unit connected by a trace 407*a*-407 to an associated switch 302*a*-302*d* in the integrated circuit chip 104. However, due to a defect, one of the switches, e.g., switch 302*b*, is stuck "on", i.e., is not responsive to image data. As a result, the nozzle of the fluid ejector unit 410, associated with switch 302*b* and actuator 401*b* will eject fluid in response to application of a drive pulse on drive signal line 460, regardless of the data.

Figure 7A:
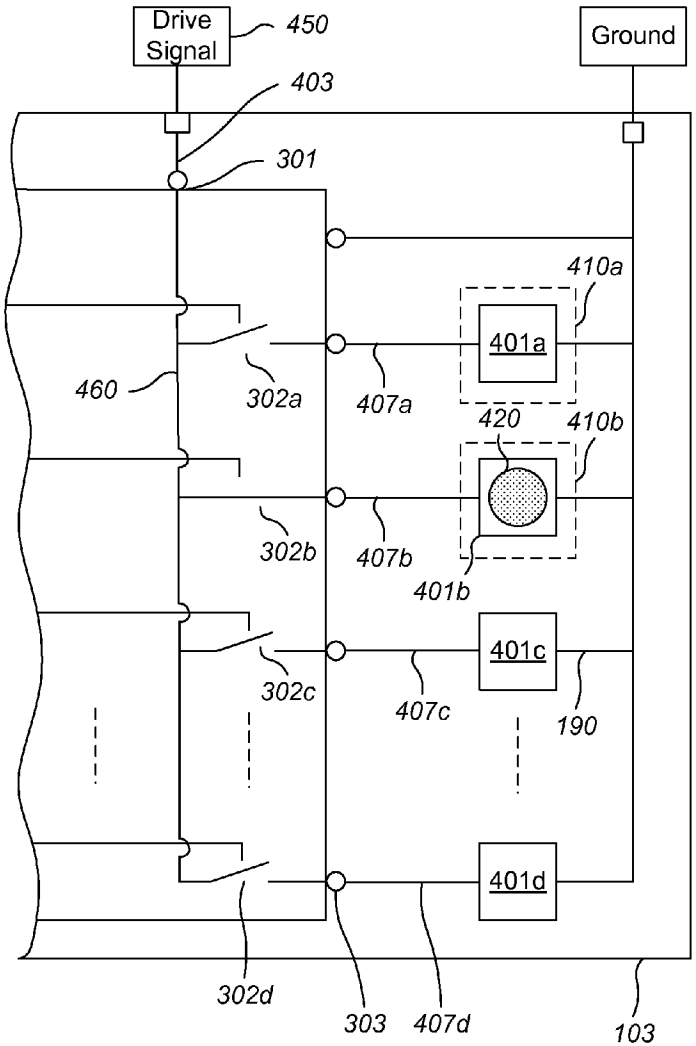
Figure 7B:
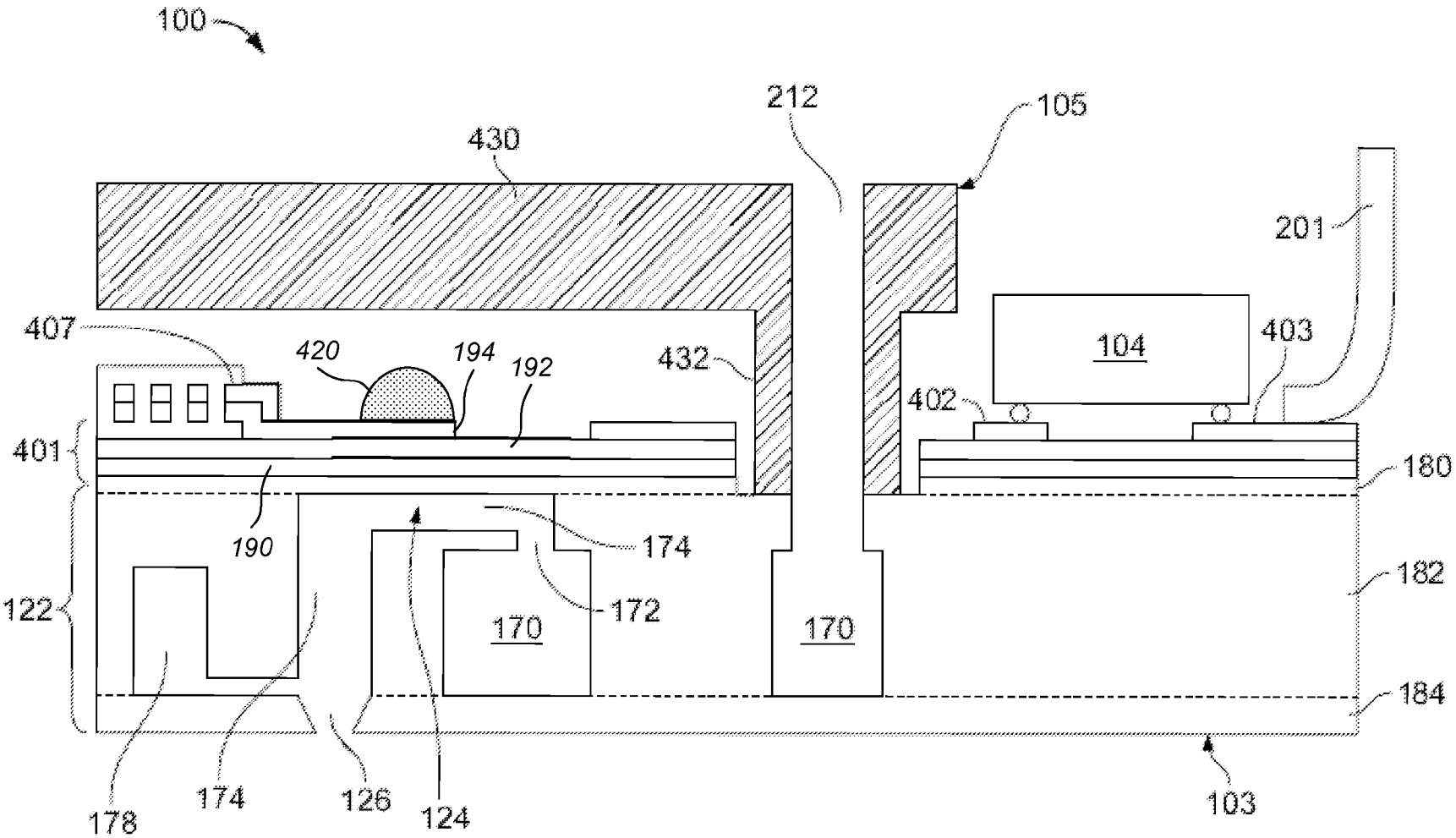
FIG. 7B is a schematic cross-sectional view of the fluid ejector module of FIG. 7A.

Referring to FIGS. 7A and 7B, by depositing a material 420 on the actuator assembly of the fluid ejector unit 410*b* to which the defect is connected, the fluid ejector unit 410*b* can be prevented from firing. Without being limited to any particular theory, the deposited material 420 can impede actuation of the membrane by the actuator by increasing the mass that the actuator must displace and/or by increasing the stiffness of the overall assembly (including the membrane, actuator and deposited material itself). In particular, the actuation can be sufficiently impeded that, when a drive pulse is applied to the actuator 401*b*, e.g., from the integrated circuit chip 104, the actuator 401*b* does not apply sufficient pressure to the chamber to cause the fluid ejector unit to eject a droplet. In contrast, for other fluid ejector units on which the material 420 is not deposited, e.g., fluid ejector unit 410*a*, assuming that the image data indicates that a drop is to be ejected, when a drive pulse is applied, the actuator will apply sufficient pressure to the chamber to cause the fluid ejector unit to eject a droplet.

In some implementations, the material deposited on the actuator assembly is an adhesive, e.g., a glue or epoxy. In other implementations, the material deposited on the actuator assembly is a solder. The exact amount of material necessary to prevent the actuator from firing in response to the drive signal depends on the original elastic modulus of the actuator assembly, the elastic modulus of the material, and the magnitude of the drive pulse, and can be determined experimentally or from computer modeling of the mechanical response of the actuator assembly. If glue is being dispensed, a droplet of glue several microns thick can be deposited on the actuator. In some implementations, the deposited material can be cured so as to further increase its stiffness.

The integrated circuit chip 104 can be tested after fabrication, e.g., with automated testing equipment, either before or after being mounted on the die 103. Testing reveals which switches are defective. The identity of any defective switch is recorded, and the physical location of the corresponding actuator that is connected to the defective switch (or will be connected once the chip 104 is mounted on the die 103) is determined. Then the material is dispensed onto the actuator. As noted above, sufficient material can be dispensed so that the actuator does not apply sufficient pressure to the chamber to cause the fluid ejector unit to eject a droplet when a drive pulse is applied to the actuator. However, the material is not dispensed onto actuators that are connected to properly functioning circuitry. The material can be dispensed onto the actuator on the die before or after the chip 104 is mounted on the die, but before the interposer 105 is attached to the die 103 or the top surface of the die is otherwise covered by the housing 110 or similar elements.

Figure 8:
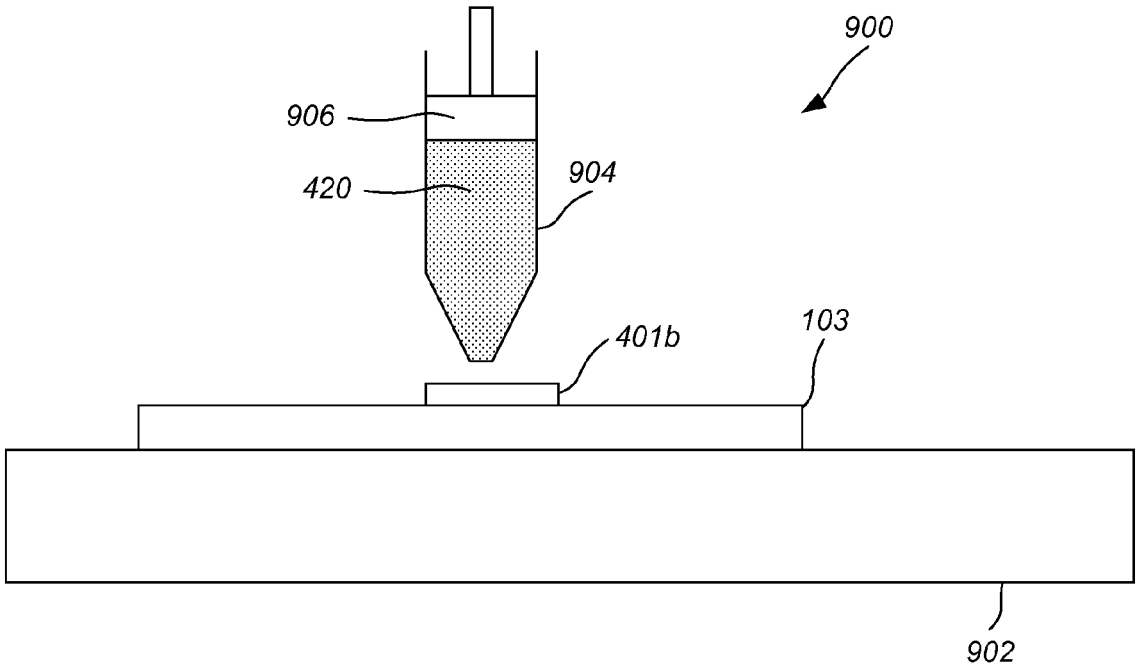
FIG. 8 is a schematic side view of a system for applying a material to an actuator of a fluid ejector module.

Referring to FIG. 8, a system 900 dispense the material 420, e.g., the glue, on the actuator includes a stage 902 to hold the die 103, e.g., with clamps or vacuum suction, and a syringe 904 holding the material to be dispensed. The motion of the plunger 906 of the syringe can be precisely controlled, e.g., by a stepper motor. In addition, the stage is precisely moveable, e.g., with stepper motors. The syringe 904 is positioned over the stage 902. A video monitoring system can provide an enlarged view of the location under the syringe (i.e., the location on the die 103 to which, given the position of the stage, the syringe will dispense material if the plunger 906 is actuated) to permit ease of control by a human operator. In operation, the stage 902 is moved by the operator to position the desired actuator 401*b* below the syringe 902, and the plunger is pushed to expel a desired amount of the material onto the actuator. In particular, the syringe can be positioned very close, but not touching the actuator. When the syringe is actuated, the material extrudes from the orifice at the end and onto the actuator. The syringe is then pulled vertically away from the die 102. In some implementations, rather than a syringe, a printhead can be used to dispense the material.

Figure 9:
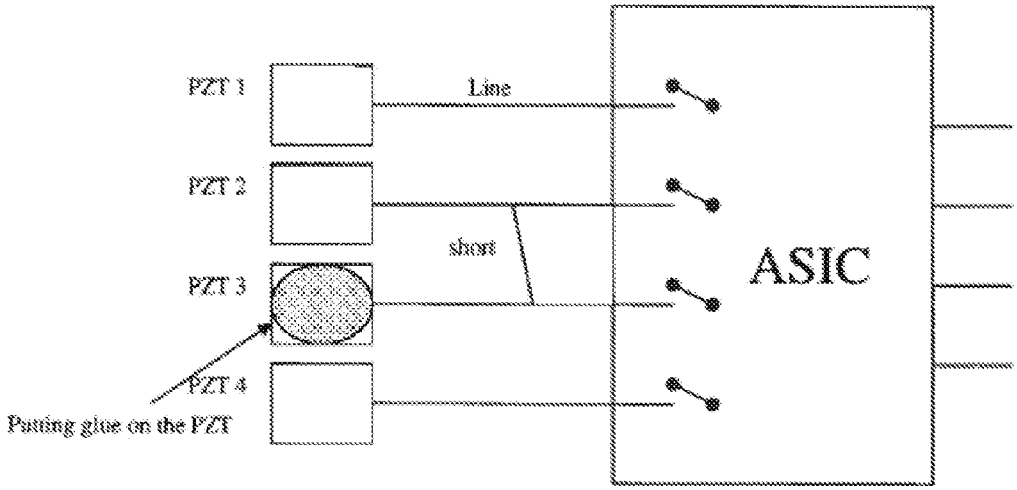
FIG. 9 is a schematic view of a short in a trace on a die and having a material deposited on an actuator connected to the shorted trace.

Referring to FIG. 9, another problem, as noted above, is that a short between traces on the fluid ejector die can degrade performance of the two nozzles corresponding to shorted traces. This problem can be solved similarly, with at least one of the fluid ejector units to which the shorted trace is attached being deactivated by having sufficient material dispensed onto the actuator such that the actuator does not apply sufficient pressure to the chamber to cause the fluid ejector unit to eject a droplet when a drive pulse is applied to the actuator.

While some implementations have been described, it should be understood that these are exemplary and that various modifications can be made without departing from the spirit or scope of the disclosure. For example, the actuators described above are piezoelectric actuators on a top surface of the die opposite to the nozzle, the actuators could be heating elements and/or be embedded in the die 103 or proximate to the nozzle. The integrated circuit elements could be formed in the die 103 itself, or in the interposer 105, rather than in a separate chip 104. The clock signal and/or latch signal could be generated internally in the chip 104 rather than received through the flex circuit. The individually controlled drive electrodes could be the bottom electrodes, and the top electrode could be a common electrode. The drive signal could be applied to the common electrode (i.e., the ground electrode in FIG. 5) rather than to the switches 302, and the switches could control whether a bias voltage is applied to the individually controlled drive electrode; the drive signal could be selected to cause the actuator to eject a fluid droplet from a nozzle only if the bias voltage is applied to the associated actuator (or to eject a fluid droplet from a nozzle only if the bias voltage is not applied to the associated actuator). The material 420 can be the outermost layer of the actuator assembly, or the material could be covered by another coating, e.g., a non-wetting layer.

What is claimed is:

1. A fluid ejection module, comprising:

a die having a plurality of substantially identical individually actuatable fluid ejector units formed therein, each fluid ejector unit including:

a flow path formed therethrough, the flow path including a pumping chamber fluidically connected to a nozzle; and an actuator assembly including a membrane providing a wall of the pumping chamber and an actuator, the actuator assembly configured to eject fluid from the pumping chamber through an associated nozzle;

wherein the plurality of individually actuatable fluid ejector units includes a plurality of individually actuatable first fluid ejector units and at least one second fluid ejector unit, wherein the actuator assembly of the at least one second fluid ejector unit includes a material deposited on the actuator such that the actuator assembly of the at least one second fluid ejector unit is stiffer than the actuator assemblies of the first fluid ejector units.

2. The fluid ejection module of claim 1, wherein the material is glue, epoxy or solder.

3. The fluid ejection module of claim 1, wherein the pumping chamber is positioned on a first side of the membrane, and wherein the material is positioned on a second side of the membrane opposite to the first side, and wherein the material is an outermost layer of the actuator assembly.

4. The fluid ejection module of claim 1, wherein a stiffness of the actuator assembly of the at least one second fluid ejector unit is at least two times greater than a stiffness of the actuator assemblies of the first fluid ejector units.

5. The fluid ejection module of claim 1, wherein a thickness of the material is between about 1 μm and 100 μm.

6. The fluid ejection module of claim 1, further comprising an integrated circuit element configured to generate a voltage pulse to actuate a plurality of actuators.

7. The fluid ejection module of claim 1, wherein the actuator includes a piezoelectric layer.

8. The fluid ejection module of claim 1, wherein the die comprises silicon.

9. The fluid ejection module of claim 6, wherein a first trace connecting the actuator assembly of the at least one second fluid ejector unit and the integrated circuit element has a short to a second trace, the second trace connecting the actuator assembly of one of the plurality of first fluid ejector units and the integrated circuit element.

10. The fluid ejection module of claim 6, wherein the integrated circuit element comprises a plurality of switching elements, and wherein a switching element connected to the actuator assembly of the second fluid ejector unit is configured to be always closed.

11. The fluid ejection module of claim 6, wherein the voltage pulse required to actuate the actuator of the second fluid ejection unit is at least twice as high as the voltage pulse required to actuate the actuators of the first fluid ejection units.

12. The fluid ejection module of claim 6, wherein the voltage pulse is sufficient to eject fluid from the plurality of first fluid ejector units, but not sufficient to eject fluid from the second fluid ejector unit.

13. The fluid ejection module of claim 12, wherein the voltage pulse is about 32V.

14. The fluid ejection module of claim 12, wherein the material is glue, epoxy or solder.

15. The fluid ejection module of claim 12, wherein the pumping chamber is positioned on a first side of the membrane, and wherein the material is positioned on a second side of the membrane, the second side opposite to the first side, and wherein the material is an outermost layer of the actuator assembly.

16. The fluid ejection module of claim 12, wherein a thickness of the material is between about 1 μm and 100 μm.

17. The fluid ejection module of claim 12, wherein a first trace connecting the actuator assembly of the second fluid ejector unit and the integrated circuit element has a short to a second trace, the second trace connecting the actuator assembly of one of the plurality of first fluid ejector units and the integrated circuit element.

18. The fluid ejection module of claim 12, wherein the integrated circuit element comprises a plurality of switching elements, and wherein a switching element connected to the actuator assembly of the second fluid ejector unit is configured to be always closed.

19. The fluid ejection module of claim 12, wherein the actuator includes a piezoelectric layer.

20. The fluid ejection module of claim 12, wherein the die comprises silicon.

21. A method of correcting fluid ejection errors, comprising:

placing a liquid on at least one second fluid ejector unit of a fluid ejection module and not on a plurality of first fluid ejector units, each fluid ejector unit including:

a flow path including a pumping chamber fluidically connected to a nozzle; and an actuator assembly including a membrane providing a wall of the pumping chamber and an actuator, the actuator assembly configured to eject fluid from the pumping chamber through an associated nozzle; and curing the liquid such that the actuator assembly of the second fluid ejector unit is stiffer than actuator assemblies of the first fluid ejector units.

22. The method of claim 21, further comprising attaching an integrated circuit element to the die prior to placing the liquid, the integrated circuit element configured to generate a voltage pulse to actuate the actuators.

23. The method of claim 22, further comprising, prior to placing the liquid, determining that a switching element of the integrated circuit element connected to the actuator assembly of the second fluid ejector unit is configured to be always closed.

24. The method of claim 22, further comprising, prior to placing the liquid, determining that there is a short in a trace connecting the actuator assembly of the second fluid ejector unit and the integrated circuit element.

* * * * *

UNITED STATES PATENT AND TRADEMARK OFFICE

CERTIFICATE OF CORRECTION

PATENT NO. : 8,317,302 B2
APPLICATION NO. : 12/727178
DATED : November 27, 2012
INVENTOR(S) : Tadashi Kyoso It is certified that error appears in the above-identified patent and that said Letters Patent is hereby corrected as shown below:

In Claim 1, line 61, after "than" delete "the".

Signed and Sealed this
Fifth Day of March, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,317,302 B2
APPLICATION NO. : 12/727178
DATED : November 27, 2012
INVENTOR(S) : Tadashi Kyoso It is certified that error appears in the above-identified patent and that said Letters Patent is hereby corrected as shown below:

IN THE CLAIMS

In Claim 1, Column 8, line 61, after "than" delete "the".

This certificate supersedes the Certificate of Correction issued March 5, 2013.

Signed and Sealed this
Ninth Day of April, 2013

Teresa Stanek Rea
*Acting Director of the United States Patent and Trademark Office*